United States Patent [19]

Inoue et al.

[11] 4,315,619

[45] Feb. 16, 1982

[54] PROCESS AND SYSTEM FOR RECOVERING TOP GAS FROM BLAST FURNACE OR THE LIKE

[75] Inventors: Kazumi Inoue; Shunzo Tono; Masaoki Takahashi, all of Yokohama, Japan

[73] Assignee: Ishikawajima-Harima Jukogyo Kabushiki Kaisha, Tokyo, Japan

[21] Appl. No.: 159,591

[22] Filed: Jun. 16, 1980

[30] Foreign Application Priority Data

Oct. 30, 1979 [JP] Japan ..... 54/140159

[51] Int. Cl.[3] ..... F27B 11/12

[52] U.S. Cl. ..... 266/89; 266/144

[58] Field of Search ..... 266/89, 144, 157, 58, 266/59, 44; 75/41

[56] References Cited

U.S. PATENT DOCUMENTS 3,343,825 9/1967 Tsutumi et al. ..... 266/89

3,735,970 5/1973 Genge ..... 266/144 X

FOREIGN PATENT DOCUMENTS 54-28809 9/1979 Japan .

*Primary Examiner*—G. O. Peters

*Attorney, Agent, or Firm*—Alfred E. Miller

[57] ABSTRACT

A process and system for recovering the top gas from a blast furnace into a gas holder without discharging the top gas into the surrounding atmosphere so as to be utilized for various purposes, thereby overcoming the environmental pollution problems and attaining the energy saving.

6 Claims, 5 Drawing Figures

PROCESS AND SYSTEM FOR RECOVERING TOP GAS FROM BLAST FURNACE OR THE LIKE

BACKGROUND OF THE INVENTION

The present invention relates to a process and a system for recovering top gas from a blast furnace or the like.

In general, the operation of a blast furnace is carried out almost under high pressure in order to attain stabilized high productivity.

To this end, the inside of the blast furnace is communicated with the surrounding atmosphere through a hopper whose pressure is increased or decreased in such a way that the materials may be charged into the blast furnace under the same pressure as the top pressure.

In order to equalize the pressure in the hopper with the atmospheric pressure, the top gas has been in general discharged into the surrounding atmosphere through a top gas discharge duct or the like. However, the top gas contains not only a large amount (on the order of 0.3 kg/Nm$^3$) of CO which is hazardous to the health of human beings but also a large amount (on the order of from 10 to 30 g/Nm$^3$) of dust. Furthermore, the materials are charged into the blast furnace in general from 500 to 800 times a day and the volume of the top gas discharged amounts to 1000 Nm$^3$ per charge with the discharge of CO gas and dust of 200 and 15 tons, respectively. As a result, the pollution of the atmospheric air and the high-level noise produced when the top gas is discharged present very serious environmental problems. In addition, in view of the ever increasing serious energy problems, it is very uneconomical to discharge the top gas which may be burned as a fuel.

The present invention was made to overcome the above and other problems encountered in the blast furnaces which discharge the top gas to the surrounding atmosphere without any suitable processing and thermal utilization, and will become apparent from the following description of some preferred embodiments thereof taken in conjunction with the accompanying drawings.

BRIEF EXPLANATION OF THE DRAWINGS

The same reference numerals are used to designate similar parts throughout the figures.

DETAILED DESCRIPTION OF THE PREFERRED EMBODIMENTS

Figure 1:
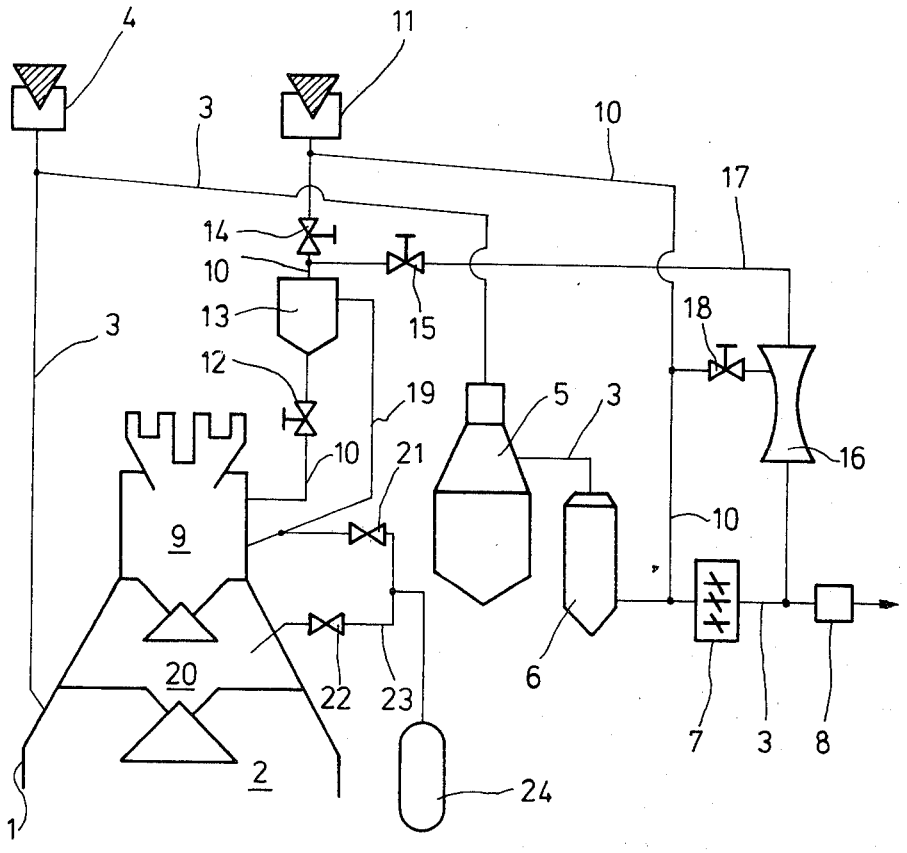
FIGS. 1 through 5 are flow charts of from first to fifth embodiments, respectively, of the present invention.

First Embodiment, FIG. 1

The top 2 of a blast furnace 1 is communicated with a top gas conduit 3 (which is referred to as "the untreated top gas conduit" because the dust-laden top gas as discharged from the top flows). The untreated top gas conduit 3 rises to an untreated top gas bleeder valve 4, which is the highest point of the untreated top gas conduit 3. From the bleeder valve 4, the untreated top gas conduit 3 descends through a dry type dust catcher 5, a primary gas cleaner 6, a top pressure control valve 7 and a secondary gas cleaner 8 and is communicated with a gas holder (not shown).

A top hopper 9 of the blast furnace 1 is communicated with a partially treated gas conduit or passage 10 which, as with the untreated top gas conduit 3, rises to and is communicated with a partially treated top gas bleeder valve 11, which is the highest point of the conduit 10, through a dust discharge valve 12, a second dust catcher 13 and a pressure equalizing valve 14. Thereafter the partially treated top gas conduit 10 descends and is communicated with the untreated top gas conduit 3 between the primary gas cleaner 6 and the top pressure control valve 7.

The partially treated top gas conduit 10 is branched between the dust catcher 13 and the pressure equalizing valve 14 and is communicated through a discharge or regulating valve 15 and a discharge gas pipeline 17 with an ejector 16. The partially treated top gas conduit line 10 is also branched between the bleeder valve 11 and the junction with the untreated top gas conduit 3 between the primary gas cleaner 6 and the top pressure control valve 7 and is communicated through an ejector driving valve 18 with the ejector 16. The outlet of the ejector 16 is communicated with the untreated top gas conduit 3 between the top pressure control valve 7 and the secondary gas cleaner 8.

The dust catcher 13 in the partially treated top gas conduit 10 is communicated not only with the top hopper 9 through a pressure discharge pipe 19 but also with a bell hopper 20 of the blast furnace through two secondary pressure equalizing valves 21 and 22 connected in series. A gas receiver 24 is communicated with the pipe 23 interconnecting between the pressure equalizing valves 21 and 22.

The secondary pressure equalizing valves 21 and 22, the pipe 23 interconnecting between them and the gas receiver 24 constitute a pressure line for raising the pressure in the top hopper 9 to the pressure level within the top 2 after the pressure equalization has been attained through the partially treated top gas conduit line 10, the pressure equalizing valve 14 and so on as will be described in more detail below.

Next the mode of operation of the first embodiment will be described. The top gas, which is always evolving in the blast furnace or shaft 1, is discharged through the untreated top gas conduit 3 into the gas holder (not shown). The top pressure control valve 7 is so manipulated as to maintain the pressure of the discharged top gas at a predetermined suitable level. When the materials are charged into the blast furnace 1, the pressure in the top hopper 9 must be made in equilibrium with the pressure in the bell hopper 20 (this step being referred to as "the pressure equalization"). In this case, the dust discharge valve 12 and the pressure equalizing valve 14 are opened while the discharge valve 15 and the ejector driving valve 18 are closed. As a result, the top gas from the top 2 flows first through the untreated top gas conduit 3 and then the partially treated top gas conduit 10 into the top hopper 9, whereby the pressure therein rises. When the pressure in the top hopper 9 is equalized with that in the bell hopper 20, the materials in the top hopper 9 are charged into the bell hopper 20. Thereafter the top hopper 9 is closed while the bell hopper 20 is opened so as to drop the materials into the top 2 of the blast furnace 1. Next the pressure in the top hopper 9 must be equalized with the surrounding atmospheric pressure (this step being referred to as "the pressure discharge"). The pressure discharge consists of two steps. In the first step, the dust discharge valve 12 and the pressure equalizing valve 14 are closed while the discharge valve 15 is opened. As a result, the gas is discharged from the top hopper 9 through the second dust catcher 13, the partially treated top gas conduit 10, the discharge pipeline 17 and the secondary gas cleaner 8 into the gas holder (not shown). In this case, the particles dispersed are trapped and collected in the second dust catcher 13. Upon completion of the first discharge step, the pressure in and adjacent to the secondary gas cleaner 8 is in general higher than the atmospheric pressure by from 650 to 1000 mm Aq. It is the second pressure discharge step that enables the pressure in the top hopper 9 to drop to the atmospheric pressure level. That is, in the second step, the ejector driving valve 18 is additionally opened so that the untreated top gas from the shaft 1 may flow through the conduit 3 and the partially treated top gas conduit 10 into the ejector 16. As a result, the pressure in the top hopper 9 is forced to drop to the atmospheric pressure level.

Dust trapped and collected in the second dust catcher 13 during the pressure discharge step is automatically returned to the blast furnace 1 during the pressure equalization step through the partially treated top gas conduit 10, the dust discharge valve 12 and the top hopper 9.

After the pressure in the top hopper 9 has been dropped to the atmospheric pressure level in the manner described above, the new materials are charged into the top hopper 9. The same operation is repeated whenever the materials are charged into the blast furnace 1.

Figure 2:
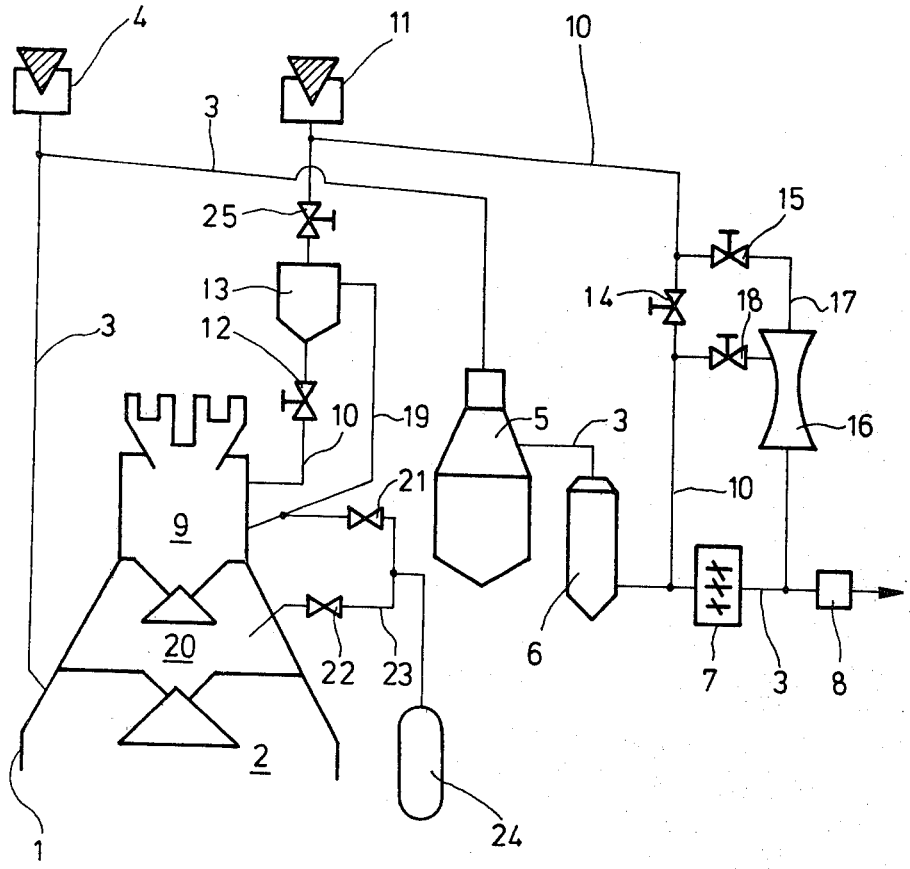

Second Embodiment, FIG. 2

In FIG. 2 is shown a second embodiment of the present invention which is substantially similar in construction described above in conjunction with FIG. 1 except that (a) the pressure equalizing valve 14 and the pressure discharge valve 15 are disposed at the downstream of the bleeder valve 11 and at such positions that an operator may operate them at the ground level or on a platform, deck or the like closer to the ground, whereby the operation may be facilitated and (b) an additional pressure discharge and equalizing valve 25 is interposed between the gas bleeder valve 11 and the second dust catcher 13 instead of the pressure equalizing valve 14.

The mode of operation of the second embodiment is also substantially similar to the first embodiment except some operations to be described below. That is, in the case of the pressure equalization, in addition to the operations of the valves described in conjunction with the first embodiment (the dust discharge valve 12 and the pressure equalizing valve 14 are opened while the pressure discharge valve 15 and the ejector driving valve 18 are closed), the pressure discharge and equalizing valve 25 is kept opened. Then the top gas flows into the top hopper 9 through the conduits 3 and 10, whereby the pressure equalization may be accomplished. Once the pressure equalization is accomplished, the pressure discharge and equalization valve 25 is closed. In the case of the pressure discharge, the pressure discharge and equalization valve 25 is opened when the pressure discharge step is to be started while it is closed after the pressure discharge, in addition to the manipulation of other valves described above in conjunction with the first embodiment.

In the second embodiment, when the pressure discharge valve 15 is closed while the pressure equalizing valve 14 is opened, or vice versa, prior to the opening of the pressure discharge and equalization valve 25 in the case of the pressure discharge, the passage from the pressure discharge and equalizing valve 25 to the pressure equalizing valve 14 or the pressure discharge valve 15 may be previously discharged. As a result, the second embodiment is advantageous in that the interval of time required for discharging the pressure in the top hopper 9 or equalizing the pressure in the top hopper 9 with the atmospheric pressure may be considerably shortened.

However, if the shortening of the pressure discharge period is not needed, the pressure discharge and equalizing valve 25 may be normally kept opened except in case of emergency when the bleeder valve 11 must be opened, so that the pressure discharge from the bell top 9 may be accomplished only by the manipulation of the pressure equalizing valve 14 and the pressure discharge valve 15.

Figure 3:
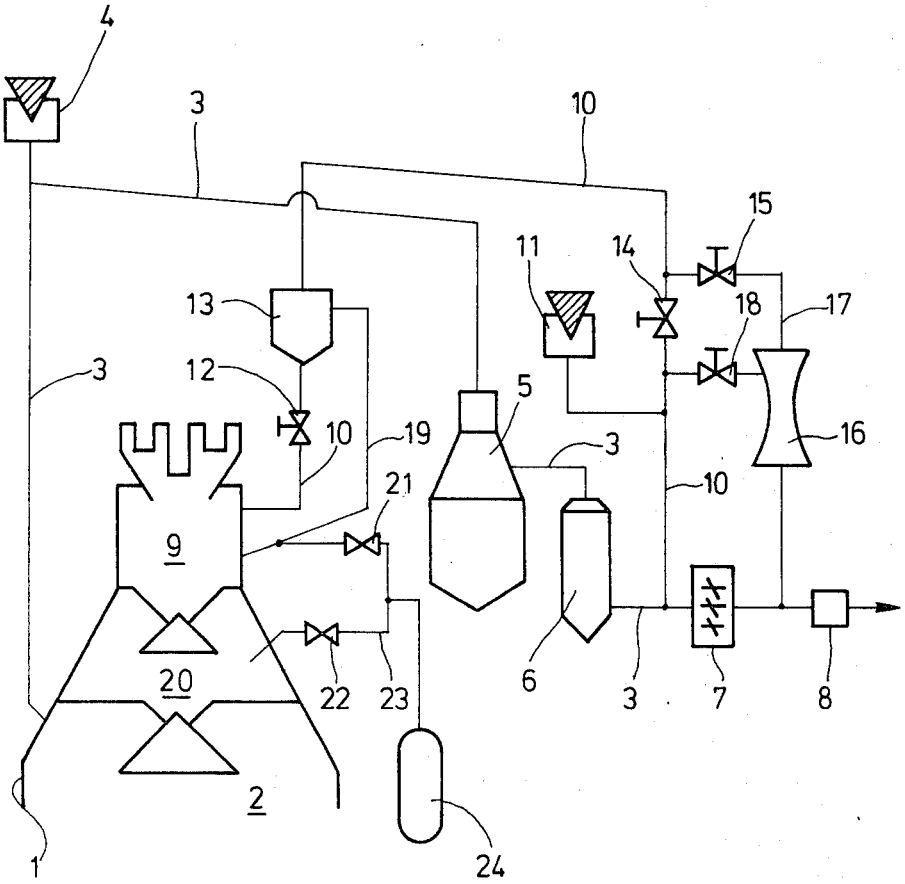

Third Embodiment, FIG. 3

In FIG. 3 is shown a third embodiment of the present invention which is substantially similar in construction to the second embodiment described above in conjunction with FIG. 2 except that the bleeder valve 11 is disposed adjacent to and directly communicated with the top pressure control valve 7 and the pressure discharge and equalizing valve 25 may be eliminated. The discharge of the pressure from the top bell 9 may be accomplished only by the manipulation of the pressure equalizing valve 14 and the pressure discharge valve 15 in a manner substantially similar to that described above.

Figure 4:
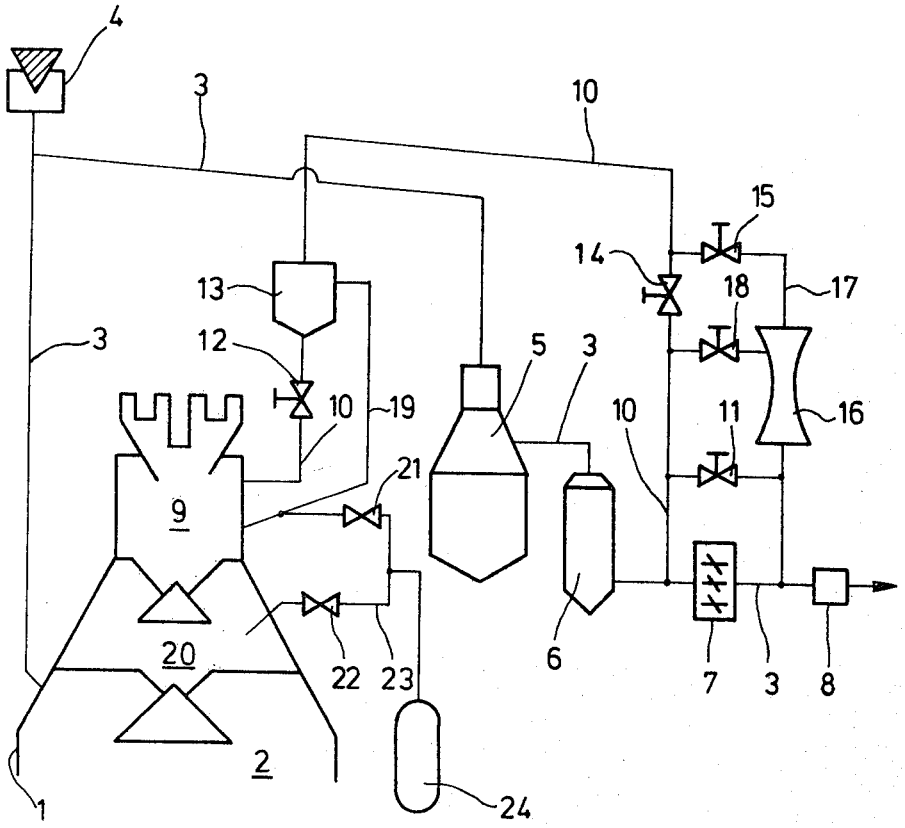

Fourth Embodiment, FIG. 4

In FIG. 4 is shown a fourth embodiment of the present invention which is substantially similar in construction to the third embodiment described above in conjunction with FIG. 3 except that the bleeder valve 11 is interconnected between the conduit 10 downstream of the pressure equalizing valve 14 and the pipeline interconnecting between the ejector 16 and the conduit 3 between the top pressure control valve 7 and the secondary gas cleaner 8. This arrangement is advantageous in that in case of emergency the pressure reduction in the top hopper 9 may be accomplished without causing any leakage of the top gas into the surrounding atmosphere. In addition, this arrangement will not adversely affect at all the normal operations or the pressure equalization and pressure discharge described above.

Figure 5:
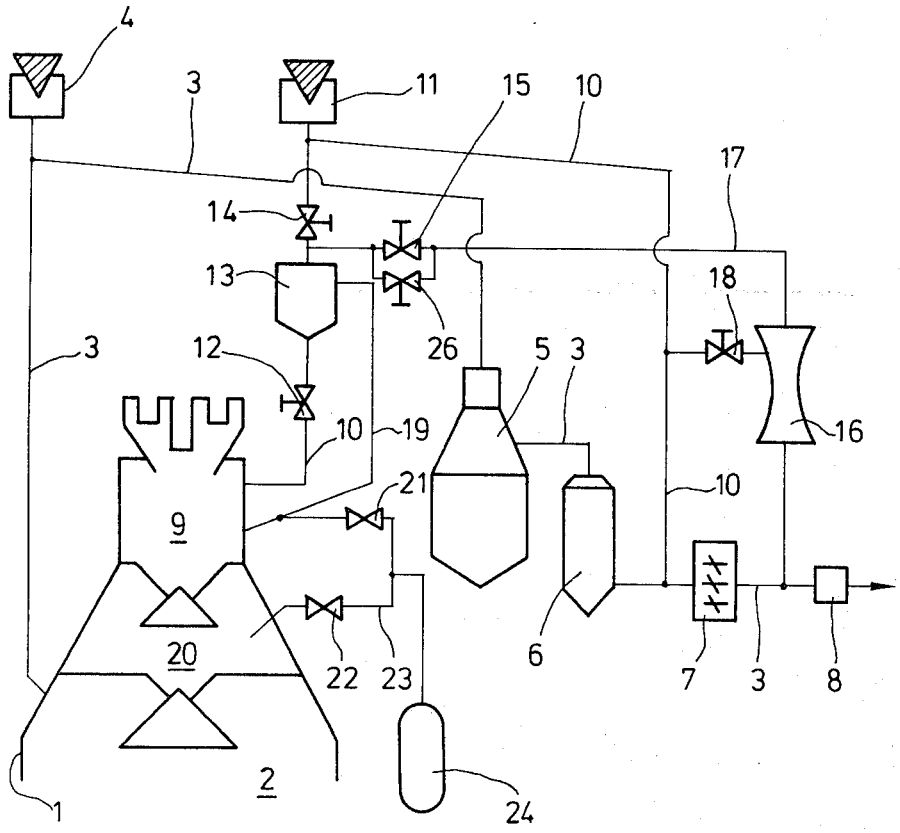

Fifth Embodiment, FIG. 5

In FIG. 5 is shown a fifth embodiment of the present invention which is substantially similar in construction to the first embodiment described above with reference to FIG. 1 except the additional provision of an emergency pressure relief valve 26 in the top gas passageway leading from the second or partially treated top gas conduit 10 via the discharge pipeline 17 to the gas holder (not shown). The emergency pressure relief valve 26 is operatively connected to a pressure sensor (not shown) disposed in the top hopper 9 and a control system (not shown) of the top gas processing system so that when the pressure in the top hopper 9 should exceed a predetermined emergency or dangerous level, the pressure relief valve 26 may be operated so as to relief the top gas. That is, the emergency pressure relief valve 26 may effectively present the opening of a small bell and/or the fracture of the top hopper 9 due to the abnormal pressure rise in the top.

It is to be understood that such an emergency pressure relief valve 26 may be also provided in any of the second through fourth embodiments described above with reference to FIGS. 2 through 4.

So far the present invention has been described in detail in conjunction with some preferred embodiments thereof and it is to be understood that various modifications may be effected without departing from the true spirit of the invention. For instance, the ejector 16 is used in the preferred embodiments as means for descharging the top gas, the ejector 16 being driven by the top gas supplied through the partially treated top gas conduit 10, but it is to be understood that any suitable medium such as a power source of steam, nitrogen gas or the like may be additionally provided to drive the ejector 16. The secondary gas cleaner 8 is disposed immediately before the gas holder (not shown), but it may be eliminated because it does not constitute the subject matter of the present invention. However it should be noted that the dust removal from the top gas by the secondary gas cleaner 8 may result in more efficient utilization of the top gas that is recovered.

In summary, according to the present invention, the top gas may be discharged into the gas holder through the top gas circuit that is totally closed. As a result, the pollution of the atmospheric air and the noise problem may be overcome. In addition, the top gas recovered in the gas holder may be utilized for various purposes so that the effective energy saving may be attained.

What is claimed is:

1. A process for recovering a top gas from a blast furnace comprising the steps of:

(a) flowing the top gas from a furnace top into a top hopper through a first untreated top gas thereby equalizing the pressure in the top hopper with the pressure in said furnace, (b) reducing the pressure in the top hopper to a predetermined level by discharging the gas in said top hopper into a gas holder through a pressure discharge pipe means in communication with said top hopper thus dropping the pressure in said top hopper to the surrounding atmospheric pressure level, (c) providing a second partially treated gas conduit means and discharge pipeline means, the latter being located in a branch conduit from said second partially treated gas conduit means and communicating with said first untreated top gas conduit at the downstream side of the junction between said first and second gas conduits, (d) and driving pressure reduction means provided in said discharge pipeline means for secondly reducing the pressure in said top hopper to the surrounding atmospheric pressure.

2. An arrangement for recovering a top gas from a blast furnace having a top hopper comprising: a first conduit means for untreated top gas, a gas holder, said first gas conduit extending from said blast furnace top to said gas holder, said first gas conduit also being provided with a top pressure control valve upstream from said gas holder, a second conduit means for partially treated top gas from said top hopper and connected to said first conduit means upstream of said top pressure control valve, a pressure equalizing valve in said second conduit means, a discharge pipeline means in a branch conduit from said second conduit means upstream from said pressure equalizing valve and communicating with said first conduit means at the downstream side of said top pressure control valve, a pressure discharge valve, and a forced pressure reduction means at the downstream side of said pressure discharge valve.

3. An arrangement for recovering a top gas from a blast furnace having a top hopper comprising: a first conduit means for untreated top gas, a gas holder, said first gas conduit extending from said blast furnace top to said gas holder, said first conduit means including a top pressure control valve at the upstream side of said gas holder, a second conduit means for partially treated top gas connected to said first conduit means for untreated top gas at the upstream side of said top pressure control valve, said second conduit means including a pressure equalizing valve, a discharge pipeline means forming a branch conduit from said second conduit means at the upstream side of said pressure equalizing valve and communicating with said first conduit means at the downstream side of said top pressure control valve, said discharge pipeline means including a pressure discharge valve and a forced pressure reduction means at the downstream side of said pressure discharge valve, and a pressure discharge and equalizing valve provided in said second conduit means at the upstream side of the junction between said second conduit means and said discharge pipeline means.

4. An arrangement for recovering a top gas from a blast furnace having a top hopper comprising: a first conduit means for untreated top gas, a gas holder, said first conduit means extending from said blast furnace top to said gas holder for introducing the top gas into said gas holder, said first conduit means including a top pressure control valve at the upstream side of said gas holder, a second conduit means for partially treated top gas connected to said first conduit means at the upstream side of said top pressure control valve, said second conduit means including a pressure equalizing valve, a discharge pipeline means forming a branch from said second conduit means at the upstream side of said pressure equalizing valve and communicating with said first conduit means at the downstream side of said top pressure control valve, said discharge pipeline means including a pressure discharge valve and a forced pressure reduction means at the downstream side of said pressure discharge valve, and an emergency pressure relief valve provided in a top gas passageway leading from said second conduit means through the discharge pipeline means to said holder.

5. An arrangement for recovering a top gas from a blast furnace having a top hopper comprising: a first conduit means for untreated top gas, a gas holder, said first gas conduit extending from said blast furnace top to said gas holder for introducing the top gas into said gas holder, said first untreated top gas conduit means including a top pressure control valve at the upstream side of said gas holder, a second partially treated top gas conduit means connected to said first conduit means at the upstream side of said top pressure control valve, said second conduit means including a pressure equalizing valve, a discharge pipeline means forming a branch from said second gas conduit means at the upstream side of said pressure equalizing valve and communicating with said first gas conduit means at the downstream side of said top pressure control valve, said discharge pipeline means including a pressure discharge valve and a forced pressure reduction means at the downstream side of said pressure discharge valve, a pressure discharge and equalizing valve provided in said second gas conduit means at the upstream side of the junction between said second gas conduit means and said discharge pipeline means, and an emergency pressure relief valve provided in a top gas passageway leading from said second conduit means through said discharge pipeline means to said gas holder.

6. An arrangement for recovering a top gas from a blast furnace as claimed in claim 2 wherein said forced pressure reduction means is an ejector.

* * * * *